United States Patent [19]

Thomsen

[11] Patent Number: 5,067,635

[45] Date of Patent: Nov. 26, 1991

[54] DISPENSER POUCH AND HOLDER AND DISPENSING UNIT THEREFOR

[76] Inventor: Peter Thomsen, 20 William Street, Henley 2111 Sydney, Australia

[21] Appl. No.: 623,097

[22] Filed: Dec. 6, 1990

Related U.S. Application Data

[63] Continuation of Ser. No. 807,293, Dec. 10, 1985, abandoned.

[51] Int. Cl.[5] ..... B65D 35/28

[52] U.S. Cl. ..... 222/103; 222/105; 222/107; 222/491

[58] Field of Search ..... 222/490, 491, 494, 207, 222/213, 214, 103, 105, 107

[56] References Cited

U.S. PATENT DOCUMENTS 3,184,121 5/1965 Volckening ..... 222/213
3,815,794 6/1974 Carlisle ..... 222/491
4,252,257 2/1981 Herzig ..... 222/491

FOREIGN PATENT DOCUMENTS 735289 5/1966 Canada ..... 222/107

*Primary Examiner*—H. Grant Skaggs
*Attorney, Agent, or Firm*—Phillips, Moore, Lempio & Finley

[57] ABSTRACT

A pair of superimposed panels are heat sealed together to define a reservoir in a dispenser pouch, adapted to contain a liquid therein. A tapered-down neck is defined on a lower end of the pouch and communicates with the reservoir to retain a pre-measured charge of the liquid therein. Narrow overlying and unsealed panel portions at the termination of the neck form a normally closed valve that opens when a predetermined external pressure is applied to the pouch.

17 Claims, 3 Drawing Sheets

DISPENSER POUCH AND HOLDER AND DISPENSING UNIT THEREFOR

CROSS-REFERENCE TO RELATED APPLICATION

This application is a continuation of U.S. Patent application Ser. No. 06/807,293, filed on Dec. 10, 1985 for "Dispenser Pouch and Method for Forming the Same", now abandoned.

TECHNICAL FIELD

This invention relates generally to a dispenser pouch adapted to contain a liquid therein and more particularly to a sealed pouch having a valve that is openable to dispense a pre-measured charge of liquid when external pressure is applied to the pouch.

BACKGROUND ART

Dispensers for liquids having relatively high viscosities, such as soap, shampoo, tomato ketchup, mayonnaisse or the like, normally take the form of a semi-rigid plastic container having an openable closure cap or a reciprocal dispensing valve mounted thereon. Conventional dispensers of this type are relatively expensive to manufacture, prone to malfunction and normally do not insure that a pre-measured charge of the liquid will be dispensed therefrom.

Other types of conventional dispensers include thin-walled plastic pouches that are heat sealed to retain a liquid product therein. A corner of the pouch is either ripped open to dispense the product or a closure plug is used for this purpose. Further, U.S. Pat. No. 3,009,498 discloses a self-sealing valve for pouches or bags which purportedly exhibits critical ratios whereby the valve will close automatically to seal the bag after product has been dispensed therefrom.

DISCLOSURE OF INVENTION

An object of this invention is to provide an improved and leak-proof dispenser pouch that is economical to manufacture and will repeatedly dispense pre-measured charges of liquid therefrom in a controlled manner.

The dispenser pouch comprises a pair of panels defining a reservoir adapted to contain a liquid therein and spout means defined on a lower end of the pouch for retaining a pre-measured charge of the liquid prior to dispensing thereof. A normally closed valve means is defined at a lower end of the spout means and between the panels for opening to dispense the pre-measured charge of liquid in response to application of a predetermined level of external pressure on the pouch.

BRIEF DESCRIPTION OF THE DRAWINGS

Other objects and advantages of this invention will become apparent from the following description and accompanying drawings wherein.

BEST MODE OF CARRYING OUT THE INVENTION

Figure 2:
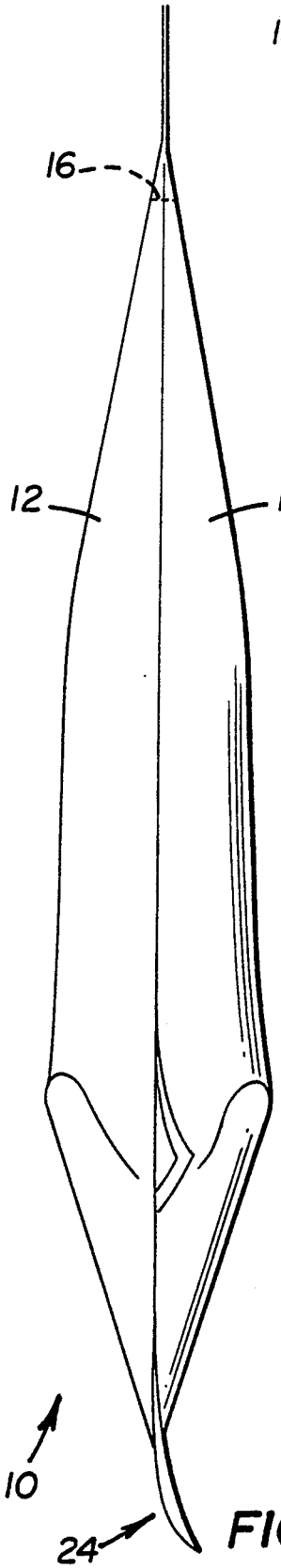
FIG. 2 is a side elevational view of the dispenser pouch.
Figure 1:
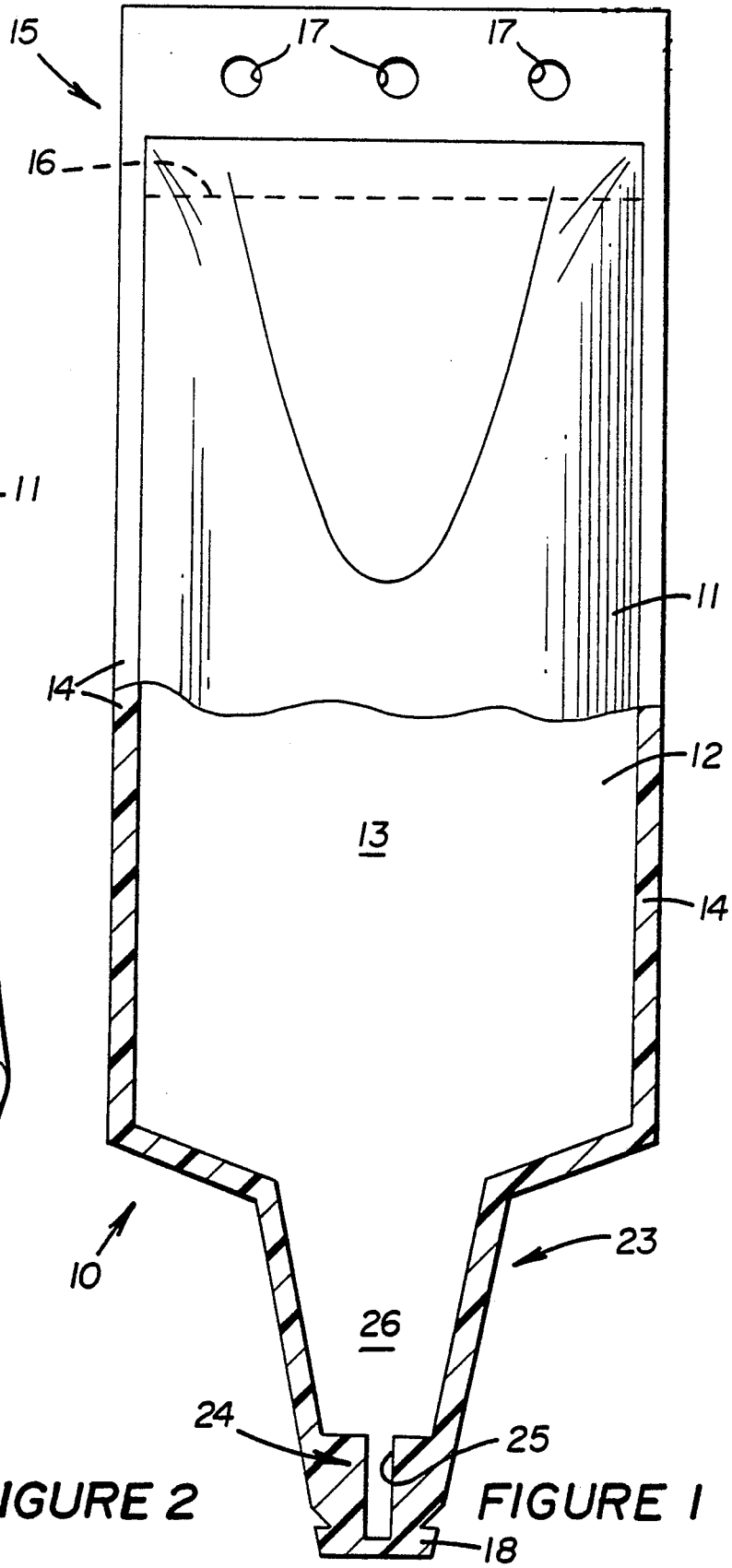
FIG. 1 is a partially sectioned front elevational view of a dispenser pouch embodying this invention.

FIGS. 1 and 2 illustrate a dispensing pouch 10 comprising a pair of superimposed front and rear panels 11 and 12, respectively. The pouch defines a reservoir 13 adapted to contain a liquid product therein, such as soap, shampoo, tomato ketchup, mayonnaisse or other suitable product in liquid form. The viscosity of the liquid product may range from that of water (1 centipoise) to that of a highly viscous liquid in the range of 1,000 centipoises.

In the preferred embodiment of this invention, panels 11 and 12 constitute a pair of separate composite plastic sheets superimposed over each other during manufacture and heat-sealed together substantially about their peripheries as depicted at 14. An upper end 15 of the dispenser pouch is preferably left open during initial stages of the packaging process to fill the pouch with a liquid product 16 to the level shown in FIGS. 1 and 2. After filling , the overlying panel portions at the upper end of the pouch are also heat-sealed together. A plurality of mounting holes 17 are formed through the pouch to adapt it for mounting purposes, as described more fully hereinafter. A lower end of the pouch is preferably closed by sealed panel portions forming a removable closure portion 18 that can be snipped-off by scissors, for example, when the dispenser pouch is placed into use by a consumer.

Figure 4:
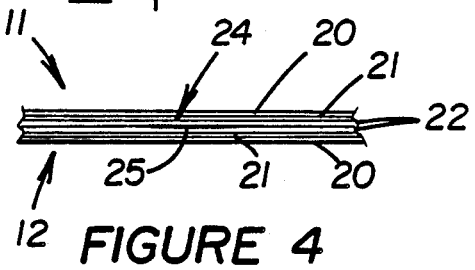
FIG. 4 is an enlarged end view of the spout and valve, taken in the direction of arrows IV—IV in FIG. 3.

Referring briefly to FIG. 4, each panel 11 and 12 is preferably composed of a cold extruded composite plastic material. For example, each panel may comprise an outer layer 20 composed of polypropylene (e.g., 1.0 mil thick), an intermediate layer 21 composed of a standard cast Nylon "VI" material (e.g., 1.25 mil thickness) and an inner layer of polyethylene (e.g., 5.0 mils thick). Individual thicknesses of the layers will vary depending on the particular consumer product application under consideration. The composite thickness of each panel 11 and 12 is preferably selected from the approximate range of from 5.0 mils to 10.0 mils for most applications of the home product type, adapted to contain from 100 ml to 1,000 ml of a liquid product in reservoir 13. Further, it is contemplated that most dispenser pouches of this type would have a total length in the approximate range of from 15.0 cm to 36.0 cm and an internal width of reservoir 13 (between heat seals 14 in FIG. 1) of from 6.0 cm to 12.0 cm.

Figure 3:
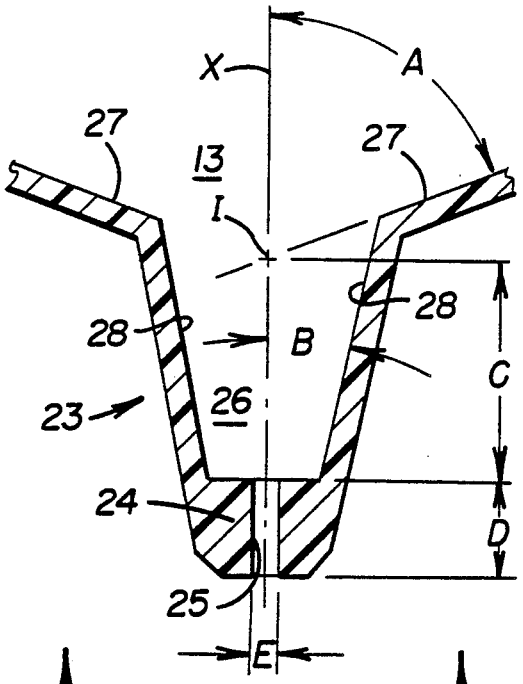
FIG. 3 illustrates design parameters for a spout and valve of the dispenser pouch.

Referring to FIGS. 1-3, dispenser pouch 10 further comprises a downwardly tapered neck or spout 23 terminating at its lower end at a valve 24, including a normally closed nozzle, canal or passage 25. Spout 23 defines a charging chamber 26 therein communicating with reservoir 13 to receive and retain a pre-measured charge of liquid 16. When the pouch is filled, valve 24 (after removal of closure portion 18) will normally close passage 25 due to a "crimping" together of overlying and unattached portions of panels 11 and 12 defining the valve and passage. When a predetermined level of external pressure is applied to reservoir 13, or preferably to charging chamber 26 directly by applying finger pressure thereto in a downward sliding movement of the fingers (FIG. 5), valve 24 will open to dispense the pre-measured charge of liquid from charging chamber 26 and through passage 25.

Figure 5:
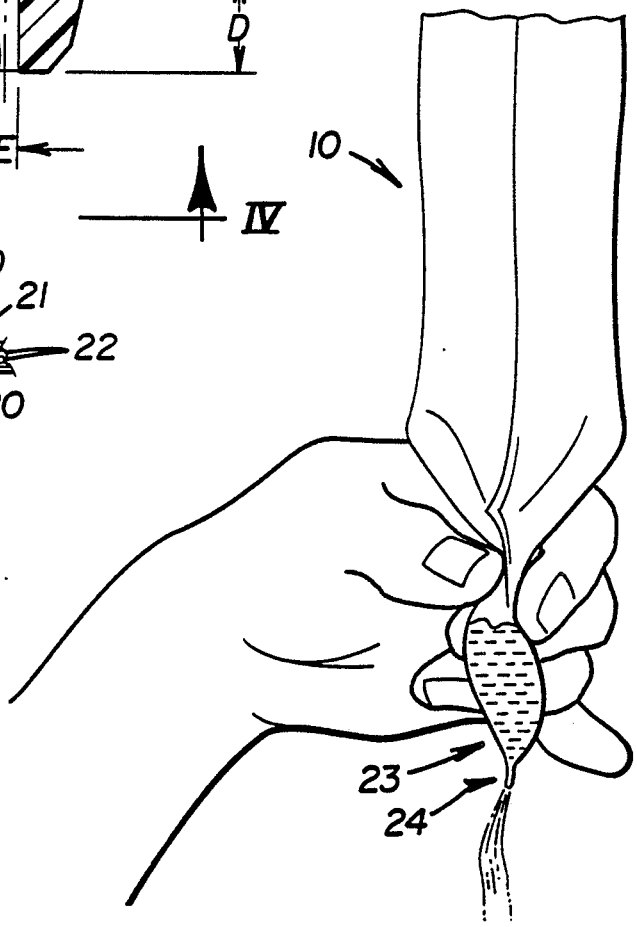
FIG. 5 illustrates the application of finger pressure to the spout to dispense a pre-measured charge of liquid product from the dispenser pouch.

As shown in FIG. 3, downwardly sloping and diverging inner sides 27 of the pouch, defining the bottom of reservoir 13, terminate at the upper extremity of spout 23. Each inner side defines an acute angle A relative to a centrally disposed longitudinal axis X of the pouch and spout, preferably selected from the range of from 45° to 80°. More preferably, the angle approximates 70°. If the angle is less than 45°, leakage may occur through passage 25 whereas if the angle exceeds 80°, charging chamber 26 may not empty fully when dispensing pressure is applied thereto (FIG. 5).

Further, spout 23 is defined, in part, by inner sides 28 thereof that preferably taper downwardly in converging relationship relative to each other with each side defining an acute angle B relative to axis X. The latter angle is preferably selected from the range of from 8.5° to 16° and still more preferably at least closely approximates 11.5°. It has been found that an angle less than 8.5° will inhibit complete filling of charging chamber 26 with liquid and that an angle exceeding 16° may induce leakage through passage 25 without external pressure being applied to the dispenser pouch.

Figure 6:
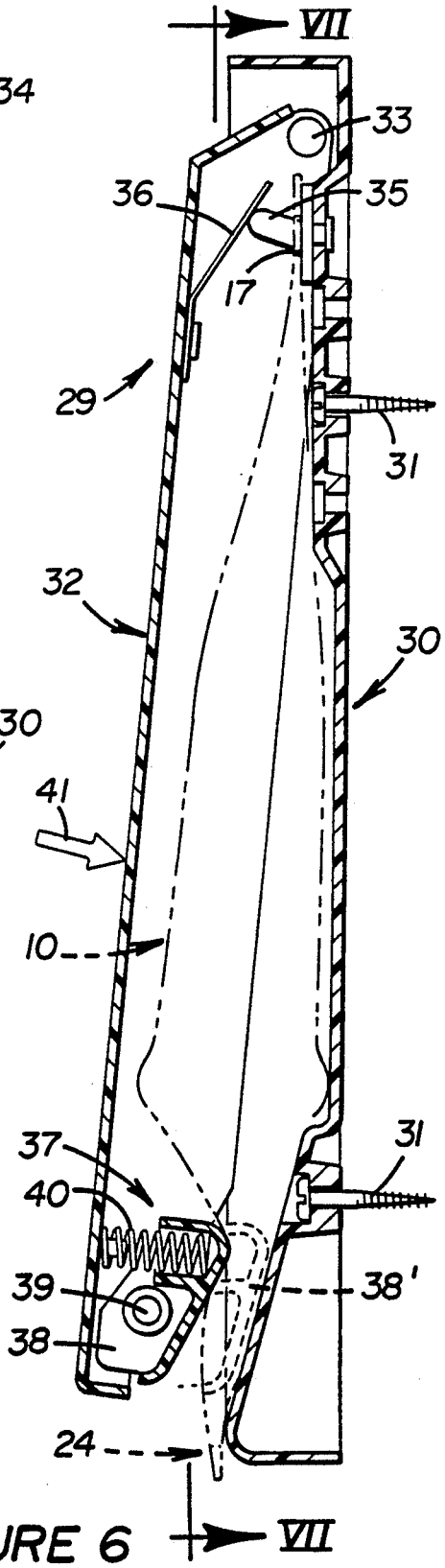
FIG. 6 is a sectioned side elevational view showing the dispenser pouch in phantom lines and mounted in a combined holder and dispensing unit therefor.

As further shown in FIG. 3, dimension C depicts the approximate length of chamber 26 in the direction of axis X, i.e., the axial distance between an intersection I of axis X with an imaginary extension of an inner side 27 of reservoir 13 and the inlet to passage 25. Length C is preferably selected from the range of from 35 mm to 63 mm. This dimension, along with the width of chamber 26, will dictate the volume of the pre-measured charge of liquid (e.g., 1.0 ml) dispensed from chamber 26 and also defines the physical configuration of spout 23 to accommodate emptying of the chamber by finger pressure (FIG. 5) or mechanically induced pressure (FIG. 6). In many consumer applications under consideration, dimension C approximated 40 mm.

Dimension D depicts the axial length of passage 25 and is preferably selected from the range of from 12 mm to 20 mm for dispenser pouches having capacities in the range of from 100 ml to 1,000 ml. A passage length approximating 15 mm has been found to function satisfactorily for most product applications under consideration.

Dimension E depicts the width of the passage and valve proper, transversely relative to axis X. This dimension is preferably selected from the range of from 2.3 mm to 5.5 mm. More preferably, this dimension closely approximates 4.2 mm in household type dispenser pouches of the type under consideration. It has been found that a passage width of less than 2.3 mm will require too high a compression pressure to open valve 24 for dispensing purposes whereas a width exceeding 5.5 mm will make the passage prone to leakage.

The dispenser pouch is particularly adapted for dispensing liquid soap, shampoo and cosmetic products in liquid form, having viscosities in the range of from 1 centipoise to 1,000 centipoise. In use, pouch 10 can be: (1) Held by hand to dispense a liquid product therefrom, such as a dishwashing detergent or the like, (2) Hung from wall hooks by use of mounting holes 17 or hung from a shower rod or the like by a hook (not shown) to allow dispensing of the product by a single hand, or (3) Mounted in the type of combined holder and dispensing unit 29 illustrated in FIGS. 6 and 7. The latter unit adapts the pouch for mechanically induced dispensing pressure in a manner described hereinafter.

Narrow passage 25 is held in a closed position to form valve 24 primarily due to the gravitational weight of the liquid product contained in reservoir 13 and communicating into charging chamber 26. In particular, the weight of the product and the resulting outward pressure imposed on overlying panels 11 and 12 in the area of spout 23, will tend to slightly stretch or flatten and compress the superimposed panel portions defining passage 25 together to thus form normally closed valve 24. Controlled product flow from chamber 26 through passage 25 will occur when the pressure applied to the pouch proper or preferably directly to the spout (FIG. 5) is greater than the pressure imposed on the spout to maintain the passage and valve closed, e.g., when a continuous and descending finger pressure approximating 15.0 psi is imposed on the spout in the manner illustrated in FIG. 5.

Figure 7:
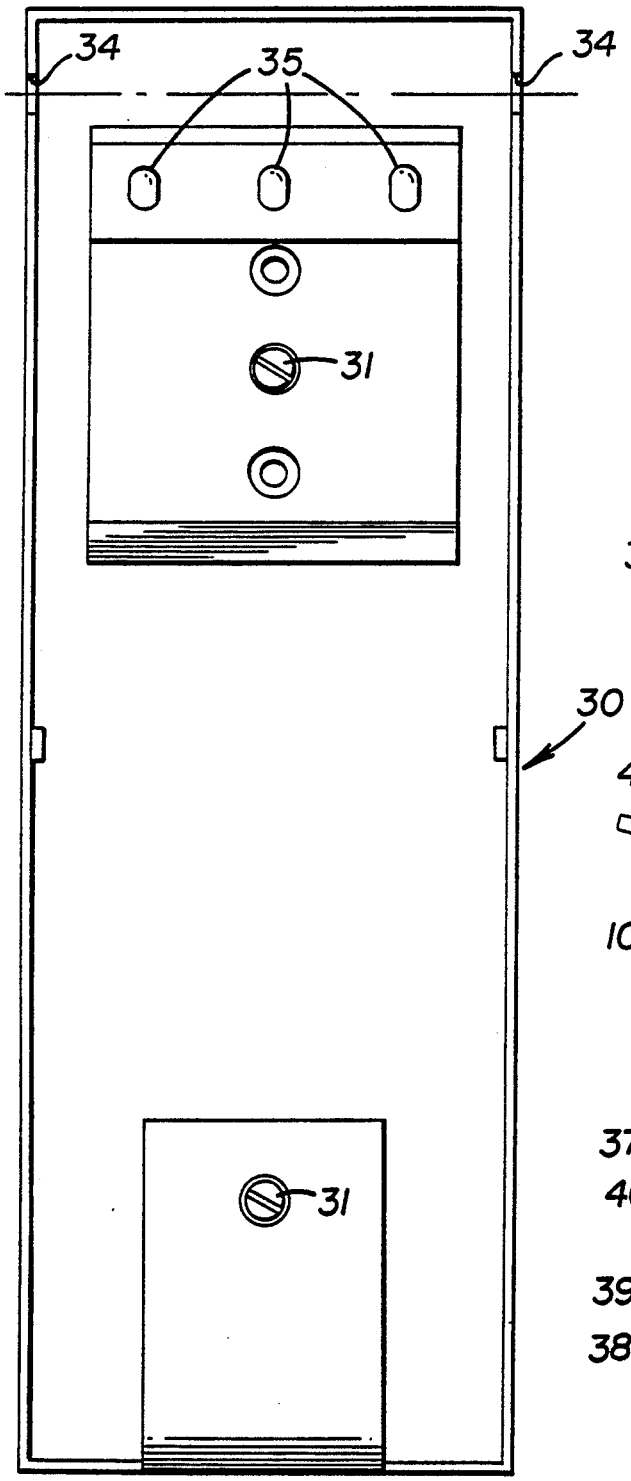
FIG. 7 is a front elevational view of a mounting bracket of the holder and dispensing unit, take generally in the direction of arrows VII—VII in FIG. 6.

Combined holder and dispensing unit 29 of FIGS. 6 and 7 comprises a mounting bracket 30 adapted to be secured on a wall or the like by fastening means 31. A cover 32 is pivotally mounted on an upper end of the mounting bracket by a transversely disposed pin 33, secured in holes 34. A plurality of mounting pins 35 are secured on the frontal side of mounting bracket 30 to removably mount pouch 10 thereon by insertion of the mounting pins through mounting holes 17. A leaf spring 36 is secured in cantilevered relationship on a backside of cover 32 and extends across the outer ends of mounting pins 35 to normally bias the cover outwardly to its retracted position illustrated in FIG. 6.

When cover 32 is pushed down towards mounting bracket 30 for dispensing purposes, a compression means 37 will function to compress spout 23 to open valve 24 to dispense a pre-measured charge of liquid product from pouch 10. The compression means comprises a cam member 38 pivotally mounted by a pin 39 on an inner side of cover 32. An upper end of the cam member is spring-biased into relatively "light" and non-dispensing contact with the pouch by a compression coil spring 40.

As shown in FIG. 6, application of hand pressure to the cover, as depicted by an arrow 41, will pivot and move cam member 38 from its solid line position to its phantom line position 38' for dispensing purposes. The motion of the cam member generally mimics the application of finger pressure to the pouch for dispensing purposes (FIG. 5) by applying pressure in a generally horizontal direction and then applying pressure in a generally vertically downward direction. Upon release of the cover, cantilevered leat spring 36 will function to again retract the cover to its FIG. 6 position to ready the unit for as subsequent dispensing function.

In general, the method for making pouch 10 comprises cutting superimposed plastic sheets of the type described above to define panels 11 and 12, having overlying body portions and spout portions. The panels are suitably heated and sealed together at peripheral portions 14 (FIG. 1) to define reservoir 13 by the reservoir portions of the panels and spout 23 by the spout portions thereof. However, lower end portions of the spout portions of the panels are left unsealed to define passage 25 which communicate with reservoir 13 in a manner described above.

Further, upper end 15 of the pouch panels are not heat sealed together initially to adapt the pouch for filling with liquid 16. After the filling operation, the overlying panel portions at the upper end of the pouch are heat sealed together to fully seal the pouch, along with removeable closure portion 18, defined at the outlet of passage 25. Mounting holes 17 may then be punched through upper end 15 of the dispenser pouch, as illustrated in FIG. 1. Pouch panels 11 and 12 may be heat-sealed together by the type of apparatus and method disclosed in U.S. Pat. No. 4,545,844 with appropriate modification being made to the disclosed cutting and sealing dies to accommodate the configuration of the panels of dispenser pouch 10.

I claim:

1. A dispenser pouch comprising a pair of panels defining a reservoir, having laterally spaced and co-extensive inner sides, adapted to contain a liquid therein, spout means defining a charging chamber, having laterally spaced and co-extensive inner sides, between opposed panel portions of said panels on a lower end of said pouch and communicating with said reservoir for retaining a pre-measured charge of said liquid therein, and normally closed valve means communicating directly with said charging chamber and terminating at an inner end thereof solely at a lower end of said spout means, including a passage solely defined by and between superimposed flat portions of said panels extending throughout the entire length of said valve means and that are normally flattened and entirely compressed together automatically in direct response to the weight of the liquid in said reservoir and spout means and resulting outward pressure on said panel portions, when said pouch is suspended vertically, to close said valve means when said charging chamber is filled with said liquid, for opening to entirely separate the superimposed flat portions of said panels to pump and solely dispense said pre-measured charge of liquid from said charging chamber in response to the application of a predetermined level of external and descending pumping pressure on said spout means, and for again closing to entirely compress said superimposed flat portions together to close said valve means when said pressure is removed from said spout means, said passage having a width throughout its entire length that is substantially less than the width of said charging chamber, the inner sides defining said reservoir comprising laterally spaced and co-extensive upper inner sides and contiguous and co-extenstive lower inner sides extending downwardly to slope towards each other and towards said spout means to intersect with a respective inner side defining said charging chamber to define a bottom termination of said reservoir and an upper termination of said charging chamber, the inner sides defining said charging chamber having lengths substantially greater than the lengths of the lower inner sides defining said reservoir and the lengths of the inner sides defining said charging chamber being substantially greater than the length of said passage.

2. The dispenser pouch of claim 1 wherein said pair of panels are heat-sealed together about peripheral portions thereof, except for remaining unsealed at said passage and at upper end portions of said panels adapted to have said liquid injected therethrough to fill said reservoir.

3. The dispenser pouch of claim 1 wherein each of said panels has a thickness selected from the approximate range of from 5.0 mils to 10.0 mils and said reservoir has a capacity of from 100 ml to 1,000 ml.

4. The dispenser pouch of claim 1 wherein each of said upper innersides defines an acute angle relative to a centrally disposed longitudinal axis of said pouch and said spout means, selected from the range of from 45° to 80°.

5. The dispenser pouch of claim 4 wherein said angle approximates 70°.

6. The dispenser pouch of claim 1 wherein the inner sides of said charging chamber slope downwardly in converging relationship relative to each other with each such inner side defining an acute angle relative to a centrally disposed longitudinal axis of said spout means.

7. The dispenser pouch of claim 6 wherein said acute angle is selected from the approximate range of from 8.5° to 16°.

8. The dispenser pouch of claim 7 wherein said acute angle at least closely approximates 11.5°.

9. The dispenser pouch of claim 6 wherein said passage has a constant width, disposed transversely relative to said centrally disposed longitudinal axis, that is selected from the approximate range of from 2.3 mm to 5.5 mm.

10. The dispenser pouch of claim 1 further comprising a combined holder and dispensing unit including a mounting bracket having said dispenser pouch mounted thereon, a cover mounted on said mounting bracket to overly said reservoir means and compression means overlying said spout means for only compressing said spout means to apply said predetermined level of external and descending pumping pressure thereon and to selectively dispense said pre-measured charge of liquid from said charging chamber through said passage.

11. The dispenser pouch of claim 10 wherein said compression means comprises cam means movably mounted on said unit for engaging and compressing said spout means to dispense said pre-measured charge of liquid from said charging chamber.

12. The dispenser pouch of claim 1 wherein a lower end of said charging chamber is defined by a pair of lower sides extending transversely between the inner sides defining said charging chamber and an upper end of said passage.

13. A dispenser pouch in combination with a combined holder and dispensing unit, said dispenser pouch comprising a pair of panels defining a reservoir adapted to contain a liquid therein, spout means defining a charging chamber between said panels on a lower end of said pouch communicating with said reservoir for retaining a pre-measured charge of said liquid therein, and normally closed valve means at a lower end of said spout means, including a normally closed passage solely defined by and between said panels and communicating with said charging chamber, for opening to dispense said charge of liquid from said charging chamber in response to the application of a pre-determined level of external and descending pumping pressure on said spout means, said holder and dispensing unit comprising a mounting bracket having said dispenser pouch mounted thereon, and compression means mounted on said unit to overly said spout means for selectively applying said predetermined level of external and descending pumping pressure by first applying pressure in a generally horizontal direction and then applying pressure in a generally vertically downward direction on said spout means to open said passage to dispense said charge of liquid therefrom.

14. The combination of claim 13 wherein said compression means comprises cam means movably mounted on said unit for engaging and compressing said spout means to dispense said pre-measured charge of liquid from said charging chamber.

15. A dispenser pouch comprising a pair of panels defining a reservoir adapted to contain a liquid therein, spout means defining a charging chamber on a lower end of said pouch communicating with said reservoir for retaining a pre-measured charge of said liquid therein, and normally closed valve means communicating directly with said charging chamber and terminating at an inner end thereof at a lower end of said spout means, including a rectangular and straight passage having parallel sides and solely defined by and between superimposed flat portions of said panels extending throughout the entire length of said valve means and that are normally flattened and compressed together to close said valve means when said charging chamber is filled with said liquid, for opening to separate the superimposed flat portions of said panels to dispense said charge of liquid from said charging chamber in response to the application of a predetermined level of external and descending pressure on said spout means, and for closing to compress said superimposed flat portions together to close said valve means when said pressure is removed from said spout means, said passage having a width substantially less than the width of said charging chamber, said panels comprising a pair of separate plastic sheets heat-sealed together about peripheral portions thereof, except for remaining unsealed at said passage and at upper end portions of said panels adapted to have said liquid injected therethrough to fill said reservoir, and wherein each of said panels comprises an outer layer of polyethylene, an intermediate layer of nylon and an inner layer of polyethylene.

16. A dispenser pouch comprising a pair of panels defining a reservoir adapted to contain a liquid therein, spout means defining a charging chamber on a lower end of said pouch communicating with said reservoir for retaining a pre-measured charge of said liquid therein, and normally closed valve means communicating directly with said charging chamber and terminating at an inner end thereof at a lower end of said spout means, including a rectangular and straight passage having parallel sides and solely defined by and between superimposed flat portions of said panels extending throughout the entire length of said valve means and that are normally flattened and compressed together to close said valve means when said charging chamber is filled with said liquid, for opening to separate the superimposed flat portions of said panels to dispense said charge of liquid from said charging chamber in response to the application of a predetermined level of external and descending pressure on said spout means, and for closing to compress said superimposed flat portions together to close said valve means when said pressure is removed form said spout means, said passage having a width substantially less that the width of said charging chamber, and wherein inner sides of said pouch, defining the bottom of said reservoir, are straight and slope downwardly and converge towards each other to terminate at an upper extremity of the said spout means.

17. A dispenser pouch comprising a pair of panels defining a reservoir adapted to contain a liquid therein, spout means defining a charging chamber on a lower end of said pouch communicating with said reservoir for retaining a pre-measured charge of said liquid therein, and normally closed valve means communicating directly with said charging chamber and terminating at an inner end thereof at a lower end of said spout means, including a rectangular and straight passage having parallel sides and solely defined by and between superimposed flat portions of said panels extending throughout the entire length of said valve means and that are normally flattened and compressed together to close said valve means when said charging chamber is filled with said liquid, for opening to separate the superimposed flat portions of said panels to dispense said charge of liquid from said charging chamber in response to the application of a predetermined level of external and descending pressure on said spout means, and for closing to compress said superimposed flat portions together to close said valve means when said pressure is removed from said spout means, said passage having a width substantially less than width of said charging chamber, and a combined holder and dispensing unit including a mounting bracket having said dispenser pouch mounted thereon, a cover pivotally mounted on said mounting bracket for movement towards and away from said dispenser pouch and compression means for compressing said dispenser pouch to selectively dispense said pre-measured charge of liquid therefrom.

* * * * *